US007600575B2

(12) United States Patent
Fredrick

(10) Patent No.: US 7,600,575 B2
(45) Date of Patent: Oct. 13, 2009

(54) MODIFIED BOX SCRAPER SYSTEM AND APPARATUS WITH TRENCH BACKFILL BLADE

(76) Inventor: Michael Fredrick, P.O. Box 546, Atascadero, CA (US) 93423

( * ) Notice: Subject to any disclaimer, the term of this patent is extended or adjusted under 35 U.S.C. 154(b) by 0 days.

(21) Appl. No.: 12/069,617

(22) Filed: Feb. 11, 2008

(65) Prior Publication Data

US 2009/0200047 A1 Aug. 13, 2009

(51) Int. Cl.
*A01B 31/00* (2006.01)
*A01B 63/00* (2006.01)

(52) U.S. Cl. ..... 172/684.5; 172/253

(58) Field of Classification Search ..... 172/684.5, 172/777, 799.5, 245, 246, 248, 249, 252, 172/253, 677, 679, 811–832, 701.1, 445.1, 172/445.2, 250, 251; 37/266, 268, 280, 281, 37/276, 407, 410

See application file for complete search history.

(56) References Cited

U.S. PATENT DOCUMENTS 2,644,251 A * 7/1953 Smith ..... 37/404
3,034,238 A * 5/1962 McGee ..... 172/777
3,044,195 A * 7/1962 Atkinson ..... 172/4.5
3,448,814 A * 6/1969 Jackson et al. ..... 172/149
3,665,622 A * 5/1972 Lamb ..... 37/407
4,073,077 A * 2/1978 Essel et al. ..... 37/281
4,299,290 A * 11/1981 Nunes, Jr. ..... 172/4.5
4,707,936 A * 11/1987 Steinhoff ..... 37/264
5,241,763 A * 9/1993 Dynan ..... 37/407
5,329,708 A * 7/1994 Segorski et al. ..... 37/231
6,848,883 B2 * 2/2005 Atencio ..... 414/724
7,429,159 B2 * 9/2008 Priest et al. ..... 414/724
2002/0000053 A1 * 1/2002 Adamic et al. ..... 37/456

OTHER PUBLICATIONS

U.S. Appl. No. 11/506,043, Frederick.

* cited by examiner

*Primary Examiner*—Robert E Pezzuto
*Assistant Examiner*—Matthew D Troutman
(74) *Attorney, Agent, or Firm*—Sandy Lipkin

(57) ABSTRACT

A modified box scraper system that is fitted with a first, second and third plurality of attachment means located on the rearward end and both sides of the box scraper allowing for the attachment of a variety of modified work implements, said modified work implements including a trench backfill blade that attaches to the box scraper and allows the operator to backfill a trench with increased precision because the trenched row material can be funneled back into the trench.

2 Claims, 3 Drawing Sheets

MODIFIED BOX SCRAPER SYSTEM AND APPARATUS WITH TRENCH BACKFILL BLADE

BACKGROUND OF THE INVENTION

1. Field of the Invention

The present invention relates generally to the field of box scrapers commonly used behind tractors.

2. Description of the Prior Art

During construction, paving, grading and the like, typically in order to be prepared for the work to be done at a given site, contractors have had to move several pieces of grading equipment to the job site. One general piece of equipment is a tractor. Tractors commonly have box scrapers attached thereto.

Box scrapers are well-known in the art of construction, paving and other earth-moving activities. Box scrapers are attached to the back of a tractor and are height adjustable. A hydraulic system is typically in place that allows the box scraper to move in a vertical direction. Traditional box scrapers typically form a small, finite number of functions.

In addition to the box scraper, tractors have a front bucket that carries loads. Generally modifications have been made to the front bucket in the past in order to enable the tractor to perform more than one function. Modifications to buckets are known in the art, but are limited to a relatively few number of versatile operations. Some modifications have been made to box scrapers as well, but suffer from the same limitation as the front bucket with regard to the number of operations that can be performed.

By providing a system wherein some or all of the equipment needed for construction, paving, grading and the like can be utilized quickly and efficiently, contractors can save money on equipment, manpower, equipment moving costs and time. The instant invention seeks to provide such a system by innovatively modifying existing box scrapers to activate innovative grading implements that have been modified for use with the modified box scraper itself.

SUMMARY OF THE INVENTION

The preferred embodiment of the present invention teaches a method and apparatus that provides for improved functionality and flexibility of a tractor. This method involves first the attachment of a modified box scraper apparatus on the back of a tractor through connection of the box scraper to a hydraulic system found on the tractor that allows for vertical movement of the box scraper. The box scraper is comprised of a main frame having a rearward end, a first side and a second side. The rearward end contains a first plurality of attachment means. The first side contains a second plurality of attachment means, and the second side contains a third set of attachment means. One of a variety of modified work implements are then attached to one or more of the attachment means.

The first plurality of attachment means is typically arrayed in a linear formation across the rearward end of the box scraper. The first plurality of attachment means is typically made up of female fittings designed to releasably accept male fittings found on the modified work implements. The second and third plurality of attachment means are also female fittings designed to releasably accept male fittings found on the modified work implements. Typically, these second and third plurality of attachment means are located on one or more locations on the first and second sides of the box scraper, around the perimeters of each side.

The first, second and third pluralities of attachment means also contain solid rubber block inserts that are placed therein to protect the female attachment means from being clogged with dirt, clay, mud, asphalt and other contaminants.

One modified work implement involves the attachment of a trench backfill blade that attaches to the box scraper and allows the operator to backfill a trench with increased precision because the trenched row material can be funneled back into the trench.

The trench backfill blade, further comprises a generally wide U-shaped member with a front face facing away from the rearward end of the main frame of the box scraper and a back face facing toward the rearward end of the main frame of the box scraper wherein the U-shaped member further comprises a center portion; a first side portion; a second side portion; a top rim; and a bottom rim; wherein the U-shaped member is attached to the rearward end of the main frame through an attachment bar that is first attached to the center portion of the U-shaped member and second attached to the rearward end of the main frame through one of the first plurality of attachment means; and wherein there is a support bar that attaches to the back face of the U-shaped member and wherein the support bar abuts against the rearward face of the main frame of the box scraper.

BRIEF DESCRIPTION OF THE DRAWINGS

For a better understanding of the present invention, reference is to be made to the accompanying drawings. It is to be understood that the present invention is not limited to the precise arrangement shown in the drawings.

DETAILED DESCRIPTION OF A PREFERRED EMBODIMENT

Figure 1:
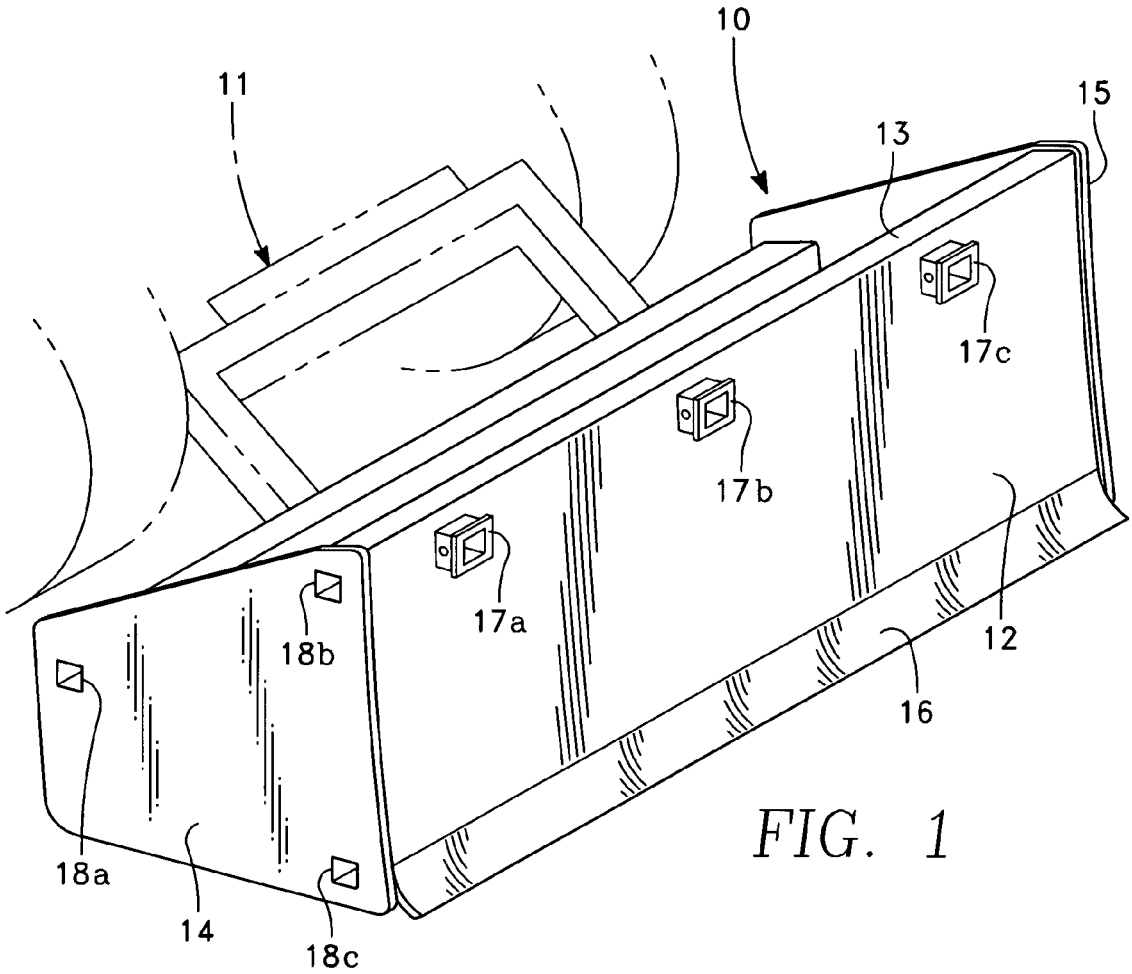
FIG. 1 is an isometric view of the modified box scraper.

Turning to the drawings, the preferred embodiment is illustrated and described by reference characters that denote similar elements throughout the several views of the instant invention.

Figure 2:
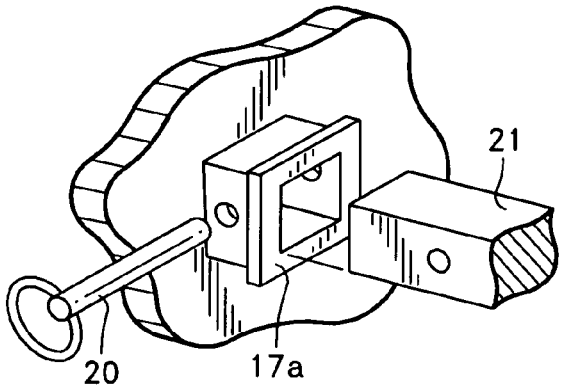
FIG. 2 is a close up view of the female attachment means located on the rearward end of the box scraper.
Figure 3:
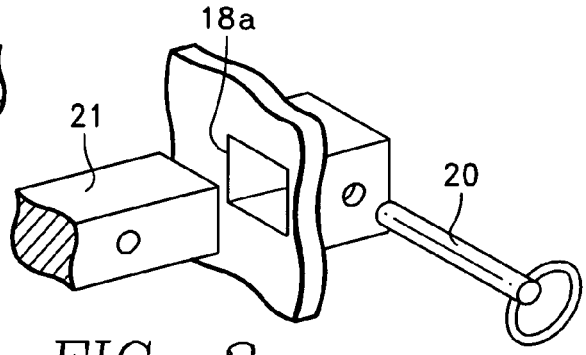
FIG. 3 is a close up view of the female attachment means located on the sides of the box scraper.
Figure 4:
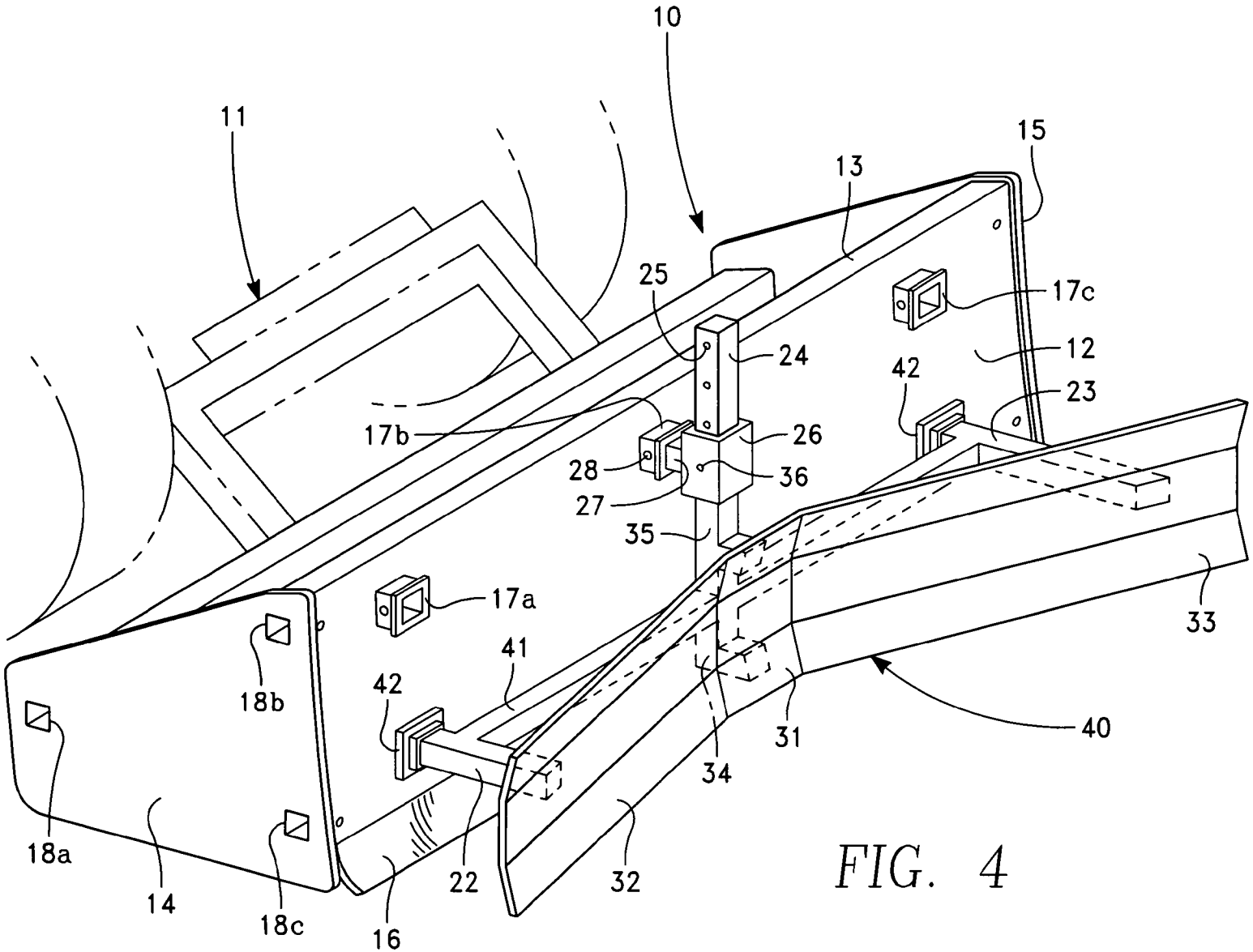
FIG. 4 is an isometric view of the box scraper with the trench backfill blade attached thereto.

Referring now to the drawings. FIGS. 1-3 show the details of the modified box scraper 10 as it attaches the rear of a tractor 11. The box scraper 10 has a main frame 13 consisting of a rearward portion 12, a first side 14 and a second side 15. The bottom portion 16 of the rearward portion 12 can be beveled, but it is considered within the scope of this invention that the bottom portion 16 could also be flat.

The rearward end 12 of the box scraper 10 has a first plurality of attachment means 17*a*, 17*b*, 17*c*. The first plurality of attachment means 17*a*, 17*b*, 17*c* is typically arrayed in a linear formation across the rearward portion 12 of the box scraper 10 and is typically made up of female fittings that are designed to releasably accept various male fittings found on one or more of the work implements.

A second plurality of attachment means 18*a*, 18*b*, 18*c* are found on the first side 14 of the box scraper 10. A third plurality of attachment means 19*a*, 19*b*, 19*c* are found on the second side 15 of the box scraper 10. The attachable work implements are variously attachable to any of these sets of attachment means 17*a*, 17*b*, 17*c*, 18*a*, 18*b*, 18*c*, 19*a*, 19*b*, 19*c*. A securing means, such as a pin 20 is used to secure the various work implements to the appropriate side of the box scraper 10.

All of the attachment means 17*a*, 17*b*, 17*c*, 18*a*, 18*b*, 18*c*, 19*a*, 19*b*, 19*c* also contain solid rubber block inserts (not shown) that are placed therein to protect the attachment means 17*a*, 17*b*, 17*c*, 18*a*, 18*b*, 18*c*, 19*a*, 19*b*, 19*c* from being clogged with dirt, clay, mud, asphalt and other contaminants. Each attachment means 17*a*, 17*b*, 17*c*, 18*a*, 18*b*, 18*c*, 19*a*, 19*b*, 19*c* is a female member that accepts a corresponding male member 21 from the appropriate work implement.

The trench backfill blade implement includes a curved member 40 that attaches to the rearward portion 12 of the box scraper 10. The curved member 40 includes a center portion 31 and a first side wing 32 and a second side wing 33 that emanate from the center portion 31 and generally create a wide U-shape.

The center portion 31 of the curved member 40 has attached thereto a connecting piece 24 that has a generally L-shaped configuration. The horizontal member 34 of the L-shaped portion is attached to the back of the center portion 31 of the curved member 40. The vertical member 35 of the L-shaped portion has a series of apertures 25 near the top. The top portion fits through a sleeve 26 that has a corresponding aperture 36 therein. The vertical portion 35 fits inside of the sleeve 26 and a chosen aperture 25 from the vertical portion 35 is aligned with the corresponding aperture 36 in the sleeve 26.

Figure 5:
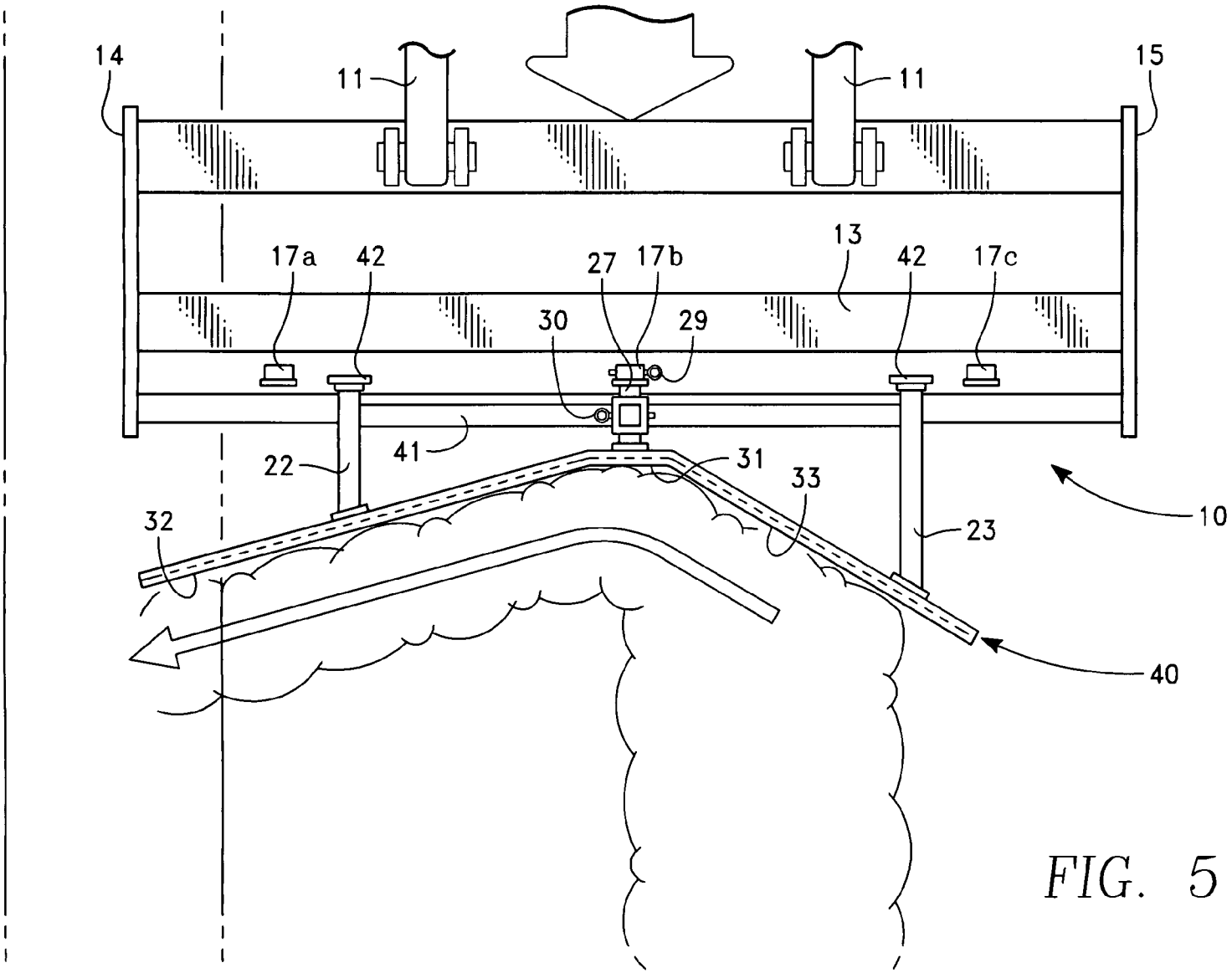
FIG. 5 is a top view of the box scraper with the trench backfill blade attached thereto.

As can be seen in the top view of FIG. 5, a pin 30 secures the vertical member 35 to the sleeve 26. The sleeve 26 is attached to a horizontal member 27 that fits into the center attachment means 17*b* of the first plurality of attachment means 17*a*, 17*b*, 17*c* found on the box scraper 10. As can be seen in the top view of FIG. 5, a pin 29 secures the horizontal member 27 to the attachment means 17*b*.

A support bar 41 runs parallel to the rearward portion 12 of the box scraper 10. This support bar 41 is attached to the center portion 31 of the curved member 40 and extends along the face of the rearward portion 12 of the box scraper. A first support bar 22 is positioned perpendicular to the support bar 41 and a second support 23 is also positioned perpendicular to the support bar 41 and substantially parallel to the first support bar 22. Both the first support bar 22 and the second support bar 23 terminate in bumpers 42 where it abuts the rearward portion 12 of the box scraper 10.

The trench backfill blade 20 attaches to the box scraper 10 and allows the operator to backfill a trench with increased precision because the trenched row material can be funneled back into the trench.

The discussion included in this patent is intended to serve as a basic description. The reader should be aware that the specific discussion may not explicitly describe all embodiments possible and alternatives are implicit. Also, this discussion may not fully explain the generic nature of the invention and may not explicitly show how each feature or element can actually be representative or equivalent elements. Again, these are implicitly included in this disclosure. Where the invention is described in device-oriented terminology, each element of the device implicitly performs a function. It should also be understood that a variety of changes may be made without departing from the essence of the invention. Such changes are also implicitly included in the description. These changes still fall within the scope of this invention.

Further, each of the various elements of the invention and claims may also be achieved in a variety of manners. This disclosure should be understood to encompass each such variation, be it a variation of any apparatus embodiment, a method embodiment, or even merely a variation of any element of these. Particularly, it should be understood that as the disclosure relates to elements of the invention, the words for each element may be expressed by equivalent apparatus terms even if only the function or result is the same. Such equivalent, broader, or even more generic terms should be considered to be encompassed in the description of each element or action. Such terms can be substituted where desired to make explicit the implicitly broad coverage to which this invention is entitled. It should be understood that all actions may be expressed as a means for taking that action or as an element which causes that action. Similarly, each physical element disclosed should be understood to encompass a disclosure of the action which that physical element facilitates. Such changes and alternative terms are to be understood to be explicitly included in the description.

What is claimed is:

1. A method for providing for improved functionality and flexibility of a tractor, comprising:

attachment of a box scraper on the back of said tractor through connection of said box scraper to a hydraulic system found on said tractor that allows for vertical movement of said box scraper, said box scraper further comprising:

a main frame having a rearward end;

a first side having three female fittings wherein said female fittings are oriented towards each other in a substantially planar triangular orientation;

and a second side having three female fittings wherein said female fittings are oriented towards each other in a substantially planar triangular orientation; and a row of three female fittings wherein said row of female fittings is positioned on said rearward end of said main frame;

releasable attachment of a modified trench backfill blade wherein said modified trench backfill blade further comprises:

an inner concave face;

an outer convex face wherein said inner concave face and said outer convex face form a substantially semicircular shape, said semicircular shape forming a first side wing, a second side wing and a substantially planar center portion located substantially equidistant from said first side wing and said second side wing wherein said substantially planar portion attaches through said outer convex face to a support bar that attaches to said rearward end of said mainframe through one of said female fittings located on said rearward end of said mainframe with a male fitting;

securing of said male fitting to one of said female fittings through pins.

2. An apparatus for providing for improved functionality and flexibility of a tractor, comprising:

a box scraper on the back of said tractor through connection of said box scraper to a hydraulic system found on said tractor that allows for vertical movement of said box scraper, said box scraper further comprising:

a main frame having a rearward end;

a first side having three female fittings wherein said female fittings are oriented towards each other in a substantially planar triangular orientation;

and a second side having three female fittings wherein said female fittings are oriented towards each other in a substantially planar triangular orientation; and a row of three female fittings wherein said row of female fittings is positioned on said rearward end of said main frame;

releasable attachment of a modified trench backfill blade wherein said modified trench backfill blade further comprises:

an inner concave face;

an outer convex face wherein said inner concave face and said outer convex face form a substantially semicircular shape, said semicircular shape forming a first side wing, a second side wing and a substantially planar center portion located substantially equidistant from said first side wing and said second wing wherein said substantially planar portion attaches through said outer convex face to a support bar that attaches to said rearward end of said mainframe through one of said female fittings located on said rearward end of said mainframe with a male fitting.

* * * * *